United States Patent [19]

Lawson

[11] Patent Number: 4,738,805

[45] Date of Patent: Apr. 19, 1988

[54] HUMIDIFIER

[76] Inventor: Ronald L. Lawson, 1226 Queen Street, Regina, Saskatchewan, Canada, S4T 4B4

[21] Appl. No.: 16,749

[22] Filed: Feb. 19, 1987

[30] Foreign Application Priority Data

Jun. 23, 1986 [CA] Canada ..... 512250

[51] Int. Cl.[4] ..... B01F 3/04

[52] U.S. Cl. ..... 261/24; 261/DIG. 15; 261/99

[58] Field of Search ..... 261/99, DIG. 15, 106, 261/24

[56] References Cited

U.S. PATENT DOCUMENTS

| | | | |
|---|---|---|---|
| 2,085,155 | 6/1937 | Heidbrink | 261/99 |
| 2,204,318 | 6/1940 | Nolan | 261/99 |
| 2,771,460 | 11/1956 | Kooistra et al. | 261/106 |
| 2,776,166 | 1/1957 | Mendelson | 261/99 |
| 3,043,573 | 7/1962 | Chandler | 261/99 |
| 3,092,096 | 6/1963 | Nett et al. | 261/DIG. 15 |
| 3,155,747 | 11/1964 | Perlman | 261/DIG. 15 |
| 3,898,922 | 8/1975 | Savage | 261/99 |
| 4,064,203 | 12/1977 | Cox | 261/99 |
| 4,175,933 | 11/1979 | James | 261/106 |
| 4,237,080 | 12/1980 | Elliott | 261/DIG. 15 |

FOREIGN PATENT DOCUMENTS

| | | | |
|---|---|---|---|
| 493735 | 10/1938 | United Kingdom | 261/99 |

*Primary Examiner*—Tim Miles

*Attorney, Agent, or Firm*—Michael M. Sakovich

[57] ABSTRACT

Apparatus for humidifying air in a hot-air furnace system or for use as an independent portable unit that also functions as an air filter, includes a closed cabinet through which air flows in a path between an air inlet opening and an air outlet opening. A water tray is positioned in the air path and a novel evaporator is suspended over the tray. The evaporator includes an upper end panel and a weighted corresponding lower end panel, both of which are perforated in a predetermined array. A continuous wick is interwoven through corresponding ones of the apertures in both panels to form a labyrinth of vertically disposed wicks that suspend the lower panel within the tray. Water is absorbed by the immersed portions of the wicks and is conducted upwardly along the wicks where it is evaporated by the flowing air.

12 Claims, 3 Drawing Sheets

HUMIDIFIER

FIELD OF THE INVENTION

This invention relates to air humidifying apparatus and more particularly to such apparatus having a wick type evaporator.

BACKGROUND OF THE INVENTION

The beneficial effects of humidifiers used in hot air heating systems are well documented. Thus, it is well known that a properly humidified residence will incur lower heating costs since a higher level of humidity inhibits moisture evaporation from the skin of a person, thereby reducing body heat loss through moisture evaporation and producing a feeling of warmth at a lower temperature.

Another significant benefit to be derived from a proper humidity level in a residence relates to the fact that dimensional stability for all hygroscopic materials within the residence is improved. Furniture joints are therefore less likely to crack and open up. Additionally, wood framing will shrink less, reducing the likelihood of cracking interior walls.

Even textile fabrics, as in draperies, may be expected to have a longer life if not subject to excessive drying as in an under humidified residence.

Another important consideration is that the quality of life is improved for the occupants since a properly controlled and adequate humidity level will reduce the drying out of mucous membranes in the respiratory tract, resulting in an improved general level of personal comfort and health.

Past efforts to achieve the aforementioned benefits in an adequately humidified residence although not exhaustive indicate the existence of a need. In the satisfaction of such need, various humidifying devices have been developed and are currently available. A common huxidifier, for exanple, employs a plurality of water absorbent plates that are often fabricated from fiberglass materials. A problem with such plates arises from the fact that they are rather brittle in nature and tend to partially disintegrate when handled or disturbed as when subjected to intermittent air pressures in a hot-air heating system. This condition is aggravated with aging of the plates and may become a health hazard to the occupants. Similar problems may also occur with drum type humidifiers using adsorbent plastic materials that may embrittle with age and disintegrate.

These problems appear to be recognized in the prior art as typified by U.S. Pat. No. 3,092,096 Nett et al which issued on June 4, 1963. According to the teachings of Nett et al, cotton wicking is beneficially used as the evaporator element of a humidifier. Nett et al discloses a complicated furnace humidifier in which a continuous length of wicking is looped around a pair of upper and lower shafts to form a plurality of elongated loops of which the lowermost portions are immersed in a wet sump whereas the uppermost portions are continually wetted by water dripping from a perforated tray. Irregular loop spacing may, however, block air flow.

SUMMARY OF THE INVENTION

A principal objective of the present invention is to provide a simple humidifier employing wicks in an evaporator from which moisture is absorbed by a continuous stream of moving air.

Another provision of the invention is an evaporator having upper and lower end panels which are held in suspended relation by a plurality of vertically disposed wicks.

Yet another provision of the invention is an evaporator in which the end panels are substantially symmetrical to facilitate insertion and withdrawal from the humidifier.

Still another provision of the invention is an evaporator that is collapsible to a small size to facilitate packaging, storing and shipping.

Still another provision of the invention is a humidifier that may be used either in a fixed furnace installation or, by the addition of a fan in an outlet opening, as a portable humidifier and air filter.

The problens associated with the prior art may be substantially overcome and the foregoing provisions achieved by recourse to the invention which is an evaporator for a humidifier having a closed cabinet through which air flows in a path between an air inlet opening and an air outlet opening including, reservoir means for containing a supply of water disposed within the air path and support bracket means disposed within the cabinet over the reservoir means. The evaporator comprises an upper end panel having a predetermined array of apertures which is adapted to slidably engage the support means and to rest thereupon over the reservoir means, a lower end panel having a corresponding array of apertures and wick means interwoven through corresponding ones of the apertures in both panels and forming a labyrinth of vertically disposed individual ones of wicks suspending the lower end panel within the reservoir in spaced relation with the upper end panel whereby water is absorbed by the immersed portions of the wicks and is conducted upwardly therealong to be evaporated by the flowing air.

DESCRIPTION OF THE DRAWINGS

The invention will now be more particularly described with reference to embodiments thereof shown, by way of exanple, in the accompanying drawings in which.

GENERAL DESCRIPTION OF THE ILLUSTRATED EMBODIMENTS

Figure 1:
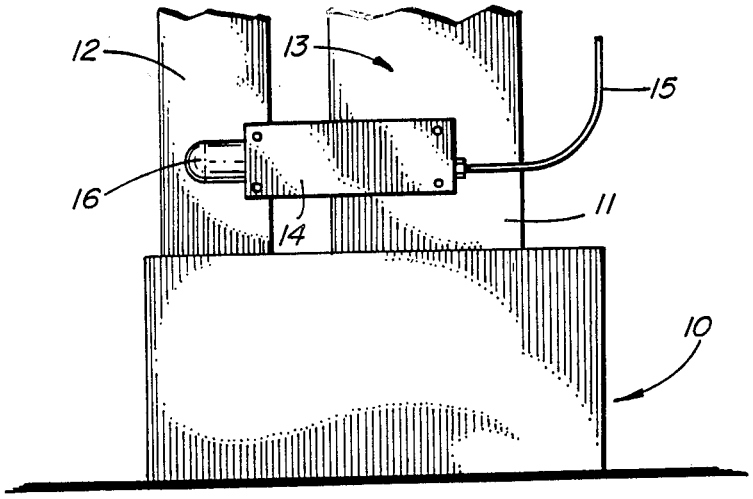
FIG. 1 is a side elevation view of a hot-air furnace showing the location of a humidifier in accordance with the present invention.

A side elevation view of a hot-air furnace 10 appears in FIG. 1 and shows a hot-air plenum 11, with a portion broken away, leading upwardly from the furnace. This represents a high pressure side of a heating system in which the furnace 10 and the plenum 11 form a part.

Adjacent to the plenum 11 is a cold air return duct 12 which is on the low pressure side of the heating system.

Positioned between the plenum 11 and the duct 12 is a humidifier 13 having a removeable side panel 14, a water inlet tube 15 leading to a source of water, not shown, and a 90° elbow 16 connecting an outlet opening of the humidifier to a corresponding inlet opening in the duct 12.

Figure 2:
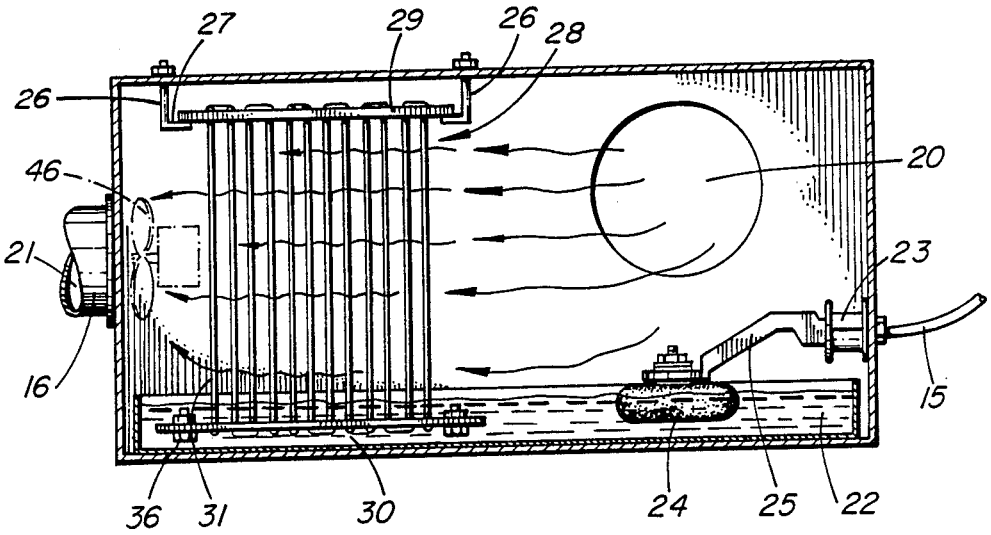
FIG. 2 is a side elevation view of the humidfier of FIG. 1 with a side panel removed to show the interior.

An enlarged view of the humidifier 13 with the panel 14 removed is shown in FIG. 2. It will be observed that with the panel 14 in place, the humidifier 13 comprises a closed cabinet through which air flows in a path between an air inlet opening 20 and an air outlet opening 21 which is in registry with an attachment portion of the elbow 16. When the furnace 10 is operating, the heated air in the plenum 11, which is at a higher pressure than the air in the duct 12, produces an air flow between the openings 20 and 21.

Disposed within this air flow are reservoir means shown as a tray 22 in which water is contained for humidifying purposes.

Means for controlling the water level within the tray 22 include a float-operated valve 23 that is actuated by float 24 which is connected to the valve 23 by way of a movable arm 25. Water conducted to the valve 23 via the tube 15 is thus controlled to establish a predetermined water level within the tray 22. Although not shown in FIG. 2, it will be understood that the float 24 is adjustably positionable on the arm 25 in order to set the water level within the tray 22 as required.

Positioned over the tray 22, a pair of support brackets 26 have inwardly facing flanges 27 from which is suspended an evaporator 28. A more detailed illustration of the evaporator 28 may be seen in FIGS. 3 and 4 which respectively illustrate two separate embodiments thereof, 28' and 28".

Figure 3:
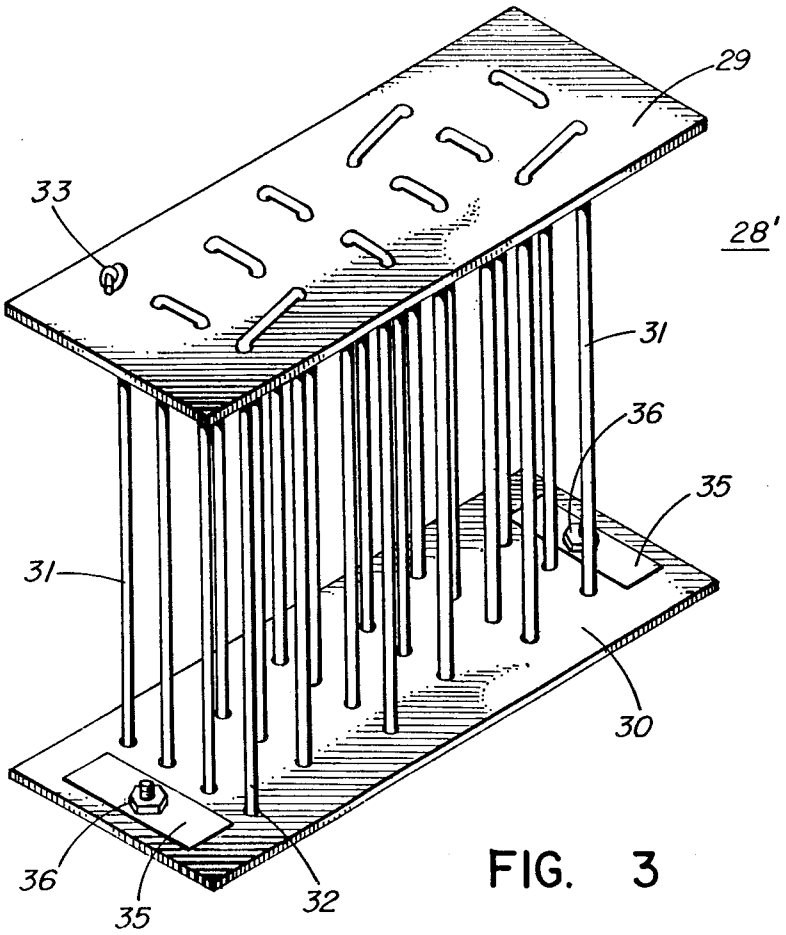
FIG. 3 is a perspcctive view of one embodiment of an evaporator shown in FIG. 2.

Having regard to FIG. 3, it will be seen that the evaporator 28' comprises an upper end panel 29 which, in FIG. 2, is shown to rest upon the flanges 27. A lower end panel 30 is suspended from the panel 29 by a plurality of wicks 31 that form a labyrinth of vertically disposed individual ones of wicks through which the flowing air moves. As indicated in FIG. 2, the lowermost ends of the wicks 31 are located within the tray 22 and normally are immersed in water. Accordingly, the immersed portions of the wicks 31 absorb water which is conducted upwardly along each wick where it is evaporated by the flowing air and subsequently discharged into the duct 12. The humidified air is then heated within the furnace 10 and is conducted through the plenum 11 for distribution as required.

In the course of such air movement, some portion of the humidified air is returned from the plenum 11 to the humidifier 13 where it is further humidified and returned to the heating system. Known humidistat means can control this effect.

The wicks 31 shown in each one of the evaporators 28' and 28" comprise a continuous length of wicking that is interwoven through corresponding ones of apertures 32 having a predetermined array which is identical in both panels 29 and 30. As will be seen in both FIGS. 3 and 4, the apertures 32 are closely spaced and are arranged in staggered rows and columns such that any one row or column has either one more or one less aperture 32 than its adjacent row or column as shown. Since the apertures 32 of the pair of end panels 29 and 30 in the evaporator 28' are in registry, the interwoven wicking provides a corresponding array of closely spaced wicks 31 as described with each wick having a uniform length.

In either evaporator 28' or 28", it will be observed that one end of the wicking includes a knot 33 to prevent the free end from slipping through its corresponding aperture 32. Following the simple interweaving process which is evident from either one of FIGS. 3 and 4, the other free end of the wicking will require a like knot under the lower end panel to maintain a neat array of wicks 31 as shown.

Spacing of the apertures 32 is not critical and will depend upon the wick density required. As the amount of water evaporated from the wicks is directly proportional to the total surface area thereof, wick diameter as well as length must also be taken into consideration when laying out the aperture 32 array. In addition, due consideration must be given to the spacing between individual ones of the wicks 31 to ensure an adequate movement of air through the humidifier in the interest of effective operation.

Efficiency of operation is readily maintained in the humidifier 13 by keeping the tray 22 and the evaporator 28 clean. Preventative maintenance in this respect is readily accomplished by removing the panel 14 followed by removal of the evaporator 28' by sliding the panel 29 out from the brackets 26. Due to the flexible structure inparted by the wicks 31 to the evaporator 28', the evaporator may be readily removed without disturbing the tray 22. The evaporator 28' could then be washed, rinsed and replaced. However, when hard water deposits are evident on the wicks 31, it is likely that similar deposits will appear in the tray 22 necessitating cleaning the tray as well as the evaporator 28'.

Parallel spacing of the wicks 31 is maintained in the evaporator 28' embodiment by means of weights 35 which may be attached to the panel 30 as by a fastener 36 or moulded in position in the event that the panel 30 is fabricated from a suitable dielectric, non-hygroscopic material. The choice of this material is not critical and many plastics would be entirely adequate provided that temperature extremes encountered within the humidifier 13 could be tolerated.

Although only the lower panel 30 need be weighted to apply tension to the wicks 31 so as to maintain their parallel alignment, the upper end panel 29 may be similarly weighted to facilitate inverting the evaporator 28' which may be required as hard water deposits build up on the lower portions of the wicks during the service life thereof. In this regard, the service life may be extended by inverting the evaporator 28' so that the other end of the wicks 31 may be immersed in the water contained in the tray 22.

Figure 4:
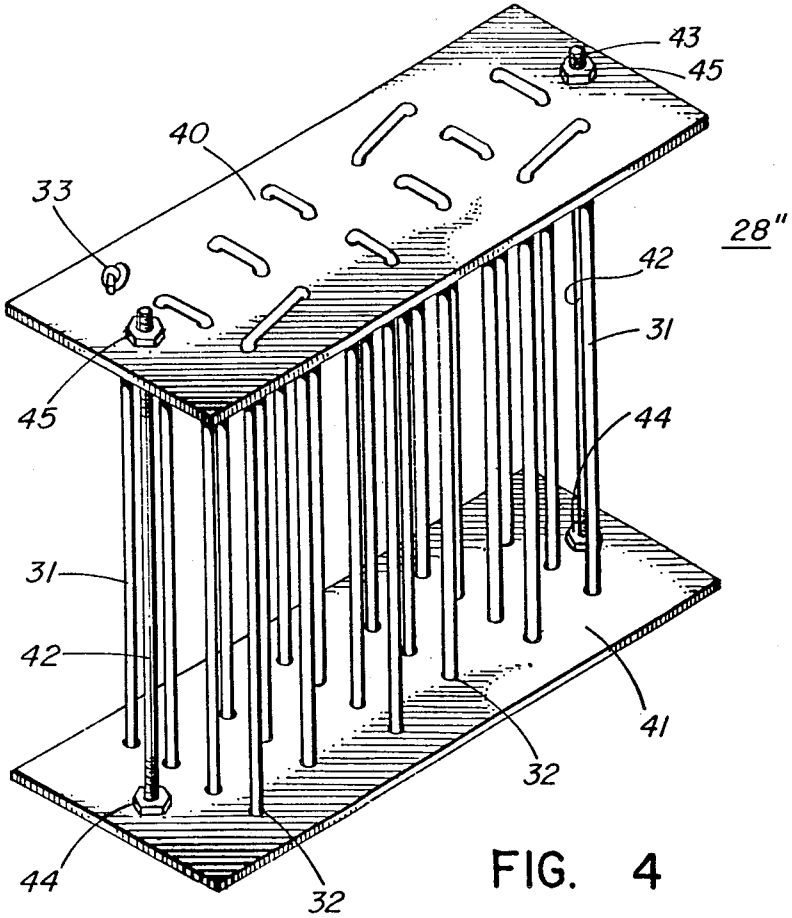
FIG. 4 is a perspective view of an alternate embodiment of an evaporator shown in FIG. 2.

While similar in most respects, the evaporator 28" of FIG. 4 differs from the evaporator 28' in the manner in which an upper end panel 40 and a lower end panel 41 are maintained in spaced parallel relation. Unlike the weighted arrangement illustrated in FIG. 3, the embodiment of FIG. 4 relies on a pair of spacer rods 42, each of which have threaded ends 43. Following the procedure of interweaving a continuous length of wicking to provide the plurality of wicks 31 as illustrated, and ensuring that each free end of the wicking is secured in place by means of a knot 33, the panels 40 and 41 are spaced apart, and the wicks 31 tensioned by means of nuts 44 which are applied to the threaded ends 43 that pass through respective corresponding pairs of apertures, not shown, in the panels 40 and 41. A second pair of nuts 45 are threaded onto the ends 43 against the panels to ensure a relatively rigid structure for the evaporator 28".

Whereas the humidifier 13 has been described in a hot-air furnace application, where it is mounted on or adjacent to the plenum 11 and the duct 12 as illustrated in FIG.1, the humidifier 13 may also be used as a portable unit. In such an application, the humidifier 13 would be free standing on any supportive surface and would likely not be connected to a source of water. In the portable version the tubing 15, together with the valve 23, the float 24 and the arm 25 would be omitted. The water source for the evaporator 28 would then be supplied manually to the tray 22 as required depending on ambient humidity and temperature conditions. To facilitate this kind of service, the panel 14 would preferably be readily removable without recourse to tools, and a motor driven fan 46, shown in broken line form in FIG. 2, could be mounted adjacent the opening 21 to draw air through the humidifier via the opening 20. Although not shown in FIG. 2, a portable service application of the type described would necessitate a screen grid overlying at least the opening 21 for shielding the fan 46 to prevent contact with its rotating blades.

The humidifier 13 embodying the fan 46 may also be used advantageously in a hot-air furnace application without disturbing the heating efficiency of the system. Thus, instead of communicating the openings 20 and 21 with the plenum 11 and the duct 12, respectively, thereby establishing a flow of circulating air therebetween that will affect heating efficiency, the openings 20 and 21 are arranged to communicate with either the plenum 11 or the duct 12. Because the fan 46 circulates air only through the plenum 11 or the duct 12 and not therebetween, heating efficiency of the furnace is undisturbed. In this arrangement, water would be supplied automatically as previously described using the tube 15, valve 23, float 24 and the arm 25. When coupled to the duct 12 it has been deternined that an air flow of 50 to 70 cubic feet per minute through the humidifier 13 provides effective results, the control of which may be obtained via the aforementioned known humidistat means from any convenient location in a residence.

In any of the embodiments described, the same wicks 31 are used and are fabricated from pure cotton fiber which is capable of absorbing substantially more moisture than known fiberglass plates. Thus, in addition to an improved efficiency using cotton wicks, the substitution of such wicks for fiberglass plates will eliminate the generation and distribution of minute glass fibers throughout a residence, thereby avoiding a potential health hazard.

It will be apparent to those skilled in the art to which this specification is addressed that the embodiments heretofore described may be varied to meet particular specialized requirements without departing from the true spirit and scope of the invention disclosed. For example, whereas the wicks 31 are fabricated from a continuous length of wicking, an alternative structure would be to fabricate the wicks 31 in individual lengths, the free ends of which are secured to respective upper and lower end panels by means of knots. Furthermore, whereas plastic has been suggested as a suitable material from which to fabricate the panels 29 and 30, and then subsequently weighting the panels with weights 35, end panels of adequate weight may be obtained by fabricating same from stainless steel. The foregoing embodiments are therefore not to be taken as indicative of the limits of the invention but rather as exemplary structures thereof which are described by the claims appended hereto.

The embodiments of the invention in which an exclusive property or priviledge is claimed are defined as follows:

1. In a humidifier having a closed cabinet through which air flows in a path between an air inlet opening and an air outlet opening, reservoir means disposed within the cabinet to contain a supply of water, control means coupled to a source of water and communicating with the reservoir means for supplying water thereto a predetermined depth and support bracket means disposed within the cabinet over the reservoir means, an improved, frameless evaporator positioned in the air path, comprising:

an upper end panel having a predetermined array of apertures and being adaped to slidably engage the support means and to rest thereupon over the reservoir means;

a lower end panel having a corresponding array of apertures;

wick means interwoven through corresponding ones of the apertures in both panels and forming a labyrinth of vertically disposed individual ones of flexible wicks suspending the lower end panel freely immersed within the reservoir means and in spaced, collapsible relation with the upper end panel whereby water is absorbed by the immersed portions of the wicks and is conducted upwardly therealong to be evaporated by the flowing air; and weight means engaging the lower end panel for maintaining immersion thereof during air flow through the humidifier.

2. An evaporator as claimed in claim 1 wherein at least the immersed panel is fabricated from one of, a dielectric, non-hygroscopic material and stainless steel.

3. An evaporator as claimed in claim 2 wherein the array of apertures in each panel provides a corresponding array of closely spaced wicks each having a uniform length and arranged in staggered rows and columns.

4. An evaporator as claimed in claim 3 wherein the wicks are fabricated from absorbent cotton.

5. An evaporator as claimed in claim 4 further comprising fan means disposed in the outlet opening.

6. An evaporated as claimed in claim 5 further comprising a screen grid overlying the outlet opening and attached to the cabinet for shielding the fan means.

7. A humidifier having an openably closed cabinet through which air flows in a path between an air inlet opening and an air outlet opening, comprising in combination:

reservoir means for containing a supply of water disposed within the air path;

support bracket means disposed within the cabinet over the reservoir means; and a frameless evaporator positioned in the air path and comprising:

an upper end panel having a predetermined array of apertures and being adopted to slidably engage the support means and to rest thereupon over the reservoir means;

a lower end panel having a corresponding array of apertures;

wick means interwoven through corresponding ones of the apertures in both panels and forming a labyrinth of vertically disposed individual ones of flexible wicks suspending the lower end panel freely immersed within the reservoir means and in spaced, collapsible relation with the upper end panel whereby water is absorbed by the immersed portions of the wicks and is conducted upwardly therealong to be evaporated by the flowing air; and weight means engaging the lower end panel for maintaining immersion thereof during air flow through the humidifier.

8. A humidifier as claimed in claim 7 wherein at least the immersed panel is fabricated from one of, a dielectric, non-hygroscopic material and stainless steel.

9. A humidifier as claimed in claim 8 wherein the array of apertures in each panel provides a corresponding array of closely spaced wicks each having a uniform length and arranged in staggered rows and columns.

10. A humidifier as claimed an claim 9 wherein the wicks are fabricated from absorbent cotton.

11. A humidifier as claimed in claim 10 further comprising fan means disposed in the outlet opening.

12. A humidifier as claimed in claim 11 further comprising a screen grid overlying the outlet opening and attached to the cabinet for shielding the fan means.

* * * * *